US011686046B2

(12) United States Patent
Yasui et al.

(10) Patent No.: US 11,686,046 B2
(45) Date of Patent: Jun. 27, 2023

(54) TISSUE PAPER

(71) Applicant: Daio Paper Corporation, Ehime (JP)

(72) Inventors: Shuta Yasui, Shizuoka (JP); Minoru Iwasaki, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 163 days.

(21) Appl. No.: 17/297,244

(22) PCT Filed: Nov. 22, 2019

(86) PCT No.: PCT/JP2019/045730
§ 371 (c)(1),
(2) Date: May 26, 2021

(87) PCT Pub. No.: WO2020/110924
PCT Pub. Date: Jun. 4, 2020

(65) Prior Publication Data

US 2022/0049426 A1 Feb. 17, 2022

(30) Foreign Application Priority Data

Nov. 30, 2018 (JP) ..... 2018-226102

(51) Int. Cl.

| | |
|---|---|
| ***D21H 11/04*** | (2006.01) |
| ***D21H 27/00*** | (2006.01) |
| ***D21H 17/06*** | (2006.01) |
| ***D21H 17/14*** | (2006.01) |
| ***D21H 21/22*** | (2006.01) |

(52) U.S. Cl.
CPC ..... *D21H 11/04* (2013.01); *D21H 17/06* (2013.01); *D21H 17/14* (2013.01); *D21H 21/22* (2013.01); *D21H 27/002* (2013.01)

(58) Field of Classification Search
CPC ..... D21H 11/04; D21H 17/14; D21H 21/22; D21H 27/002; D21H 11/02; A47K 10/16
See application file for complete search history.

(56) References Cited

U.S. PATENT DOCUMENTS

| | | | | | |
|---|---|---|---|---|---|
| 4,824,689 | A * | 4/1989 | Kuenn | A01N 25/34 | 427/398.2 |
| 5,705,164 | A * | 1/1998 | Mackey | D21H 21/22 | 424/401 |
| 5,716,692 | A * | 2/1998 | Warner | D21H 21/24 | 428/452 |
| 6,261,580 | B1 * | 7/2001 | Lehrter | D21H 21/22 | 428/153 |
| 6,428,794 | B1 * | 8/2002 | Klofta | D21H 17/20 | 424/401 |
| 6,860,967 | B2 * | 3/2005 | Baumoller | D21H 21/24 | 162/173 |
| 7,771,566 | B2 * | 8/2010 | Hilbig | D21H 27/40 | 162/158 |
| 9,545,365 | B2 * | 1/2017 | Seidling | A61Q 19/00 | |
| 10,794,007 | B2 * | 10/2020 | Vogt | D21H 21/24 | |
| 11,280,050 | B2 * | 3/2022 | Yasui | D21H 27/30 | |
| 11,473,246 | B2 * | 10/2022 | Yasui | D21H 27/30 | |
| 11,519,133 | B2 * | 12/2022 | Yasui | D21H 27/30 | |
| 2002/0148583 | A1 * | 10/2002 | Baumoller | D21H 21/24 | 162/158 |
| 2009/0314444 | A1 * | 12/2009 | Sorns | A61K 8/608 | 162/173 |
| 2018/0272680 | A1 | 9/2018 | Yasui | | |
| 2021/0047781 | A1 * | 2/2021 | Lang | D21H 21/18 | |
| 2022/0049426 | A1 * | 2/2022 | Yasui | D21H 21/22 | |
| 2022/0106740 | A1 * | 4/2022 | Tomioka | D21H 27/30 | |
| 2022/0127790 | A1 * | 4/2022 | Yasui | D21H 11/04 | |
| 2022/0372710 | A1 * | 11/2022 | Yasui | D21H 27/30 | |

FOREIGN PATENT DOCUMENTS

| | | | | |
|---|---|---|---|---|
| EP | 3865036 | A4 * | 7/2022 | A47K 10/16 |
| GB | 2589993 | A * | 6/2021 | B41M 1/10 |
| JP | 2012-071073 | A | 4/2012 | |
| JP | 2013-52142 | A | 3/2013 | |
| JP | 2013-052142 | A | 3/2013 | |
| JP | 2017-63882 | A | 4/2017 | |
| JP | 2017-192435 | A | 10/2017 | |
| JP | 7066600 | B2 * | 5/2022 | A47K 10/16 |
| JP | 7106807 | B2 * | 7/2022 | |
| WO | WO-2020110924 | A1 * | 6/2020 | A47K 10/16 |
| WO | WO-2022075267 | A1 * | 4/2022 | |

OTHER PUBLICATIONS

Machine Translation of JP-2012070073 A. (Year: 2012).*

* cited by examiner

*Primary Examiner* — Jose A Fortuna
(74) *Attorney, Agent, or Firm* — Arthur M. Reginelli; Renner, Kenner

(57) ABSTRACT

Provided is a moisturized tissue excellent in strength and snot wiping property. In the moisturized tissue paper, a paper thickness is 220 to 330 μm, a basis weight is 15 to 18 g/m$^2$ per ply, a proportion of NBKP in the pulp combination is more than 70 mass %, a chemical solution content is 26 to 32 mass %, an arithmetic mean curvature at a peak point of an outer surface in an unpressurized state (Spc (1)) is 4.0 to 4.8 (1/mm), and a developed area ratio at an interface on the outer surface (Sdr) is 0.020 to 0.030 (–).

2 Claims, 2 Drawing Sheets

TISSUE PAPER

TECHNICAL FIELD

The present invention relates to tissue paper, and more particularly to tissue paper containing a moisturizer.

BACKGROUND ART

Conventional moisturized tissues are mainly targeted at people who frequently blow the nose due to hay fever or a cold. These tissues are designed to have quality with a moist feeling, softness and smoothness such that the skin does not reddish or sore even after repeated use.

For improving the softness and the surface smoothness as mentioned above, conventional moisturized tissues have a high blending ratio of LBKP (hardwood kraft pulp), where for example, the ratio of NBKP (softwood kraft pulp) is 30 to 40% and the ratio of LBKP is 60 to 70% in terms of the blending ratio of pulp in base paper.

This is because the fiber of LBKP is thinner and shorter than that of NBKP, and therefore when the blending ratio is relatively increased, the ratio of LBKP on the surface layer increases to make the surface dense and smooth, so that a chemical solution containing the moisturizer remains on the surface layer, and an effect such as a moist feeling from the chemical solution is likely to develop on a paper layer surface due to moisture increase resulting from moisture absorption.

SUMMARY OF INVENTION

Technical Problem

However, such a conventional lotion tissue designed with importance put on skin touch is soft but poor in paper strength and thus apt to break, and is smooth but has a dense surface layer, so that it may be difficult to absorb a liquid such as snot.

Accordingly, a main object of the present invention is to provide a moisturized tissue which is excellent in softness and moist feeling, and also excellent in strength such as a firm feeling and resistance to breakage and snot wiping property.

Solution to Problem

The means for achieving the above-described object are as follows.

The first means is moisturized tissue paper in which a paper thickness is 220 to 330 μm, a basis weight is 15 to 18 g/m$^2$ per ply, a proportion of NBKP in constituent fiber is more than 70 mass %, an arithmetic mean curvature at a peak point of an outer surface in an unpressurized state (Spc (1)) is 4.0 to 4.8 (1/mm), and a developed area ratio at an interface on the outer surface (Sdr) is 0.020 to 0.030 (–).

The second means is moisturized tissue paper in which an amount of change between the arithmetic mean curvature at the peak point of the outer surface in an unpressurized state (Spc (1)) and an arithmetic mean curvature at the peak point of the outer surface under a pressure of 50 gf/cm$^2$ (Spc (2)) is Δ2.2 to Δ2.7 (1/mm).

The tissue paper of the second means is included in the moisturized tissue paper according to the first means.

Advantageous Effects of Invention

According to the present invention, there is provided a moisturized tissue which is excellent in softness and moist feeling, and also excellent in strength such as a firm feeling and resistance to breakage and snot wiping property.

DESCRIPTION OF EMBODIMENTS

Figure 1:
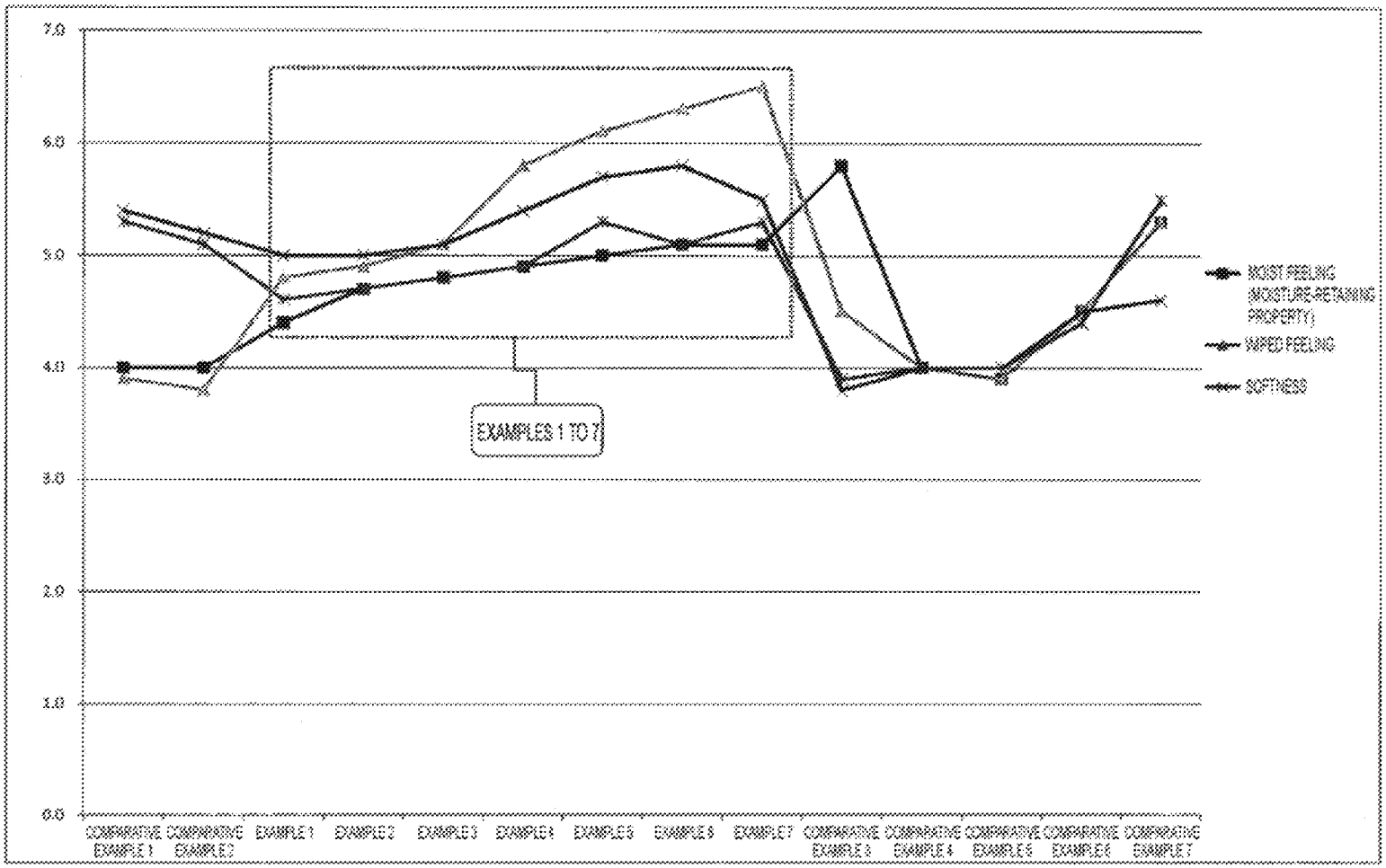
FIG. 1 graphically shows evaluation results in examples.

Hereinafter, embodiments of the present invention will be described.

The tissue paper according to an embodiment is moisturized tissue paper, and the number of plies thereof is not limited. In particular, it is desirable that the tissue paper have three plies or four plies. That is, it is preferable that three or four sheets of base paper are laminated and integrated into one set. 98 mass % or more, preferably 100 mass %, of the fiber forming the tissue paper is pulp fiber. It is desirable that pulp fiber be NBKP (softwood kraft pulp) and LBKP (hardwood kraft pulp). In particular, it is preferable that the constituent fiber is composed only of NBKP and LBKP.

In the tissue paper according to the present invention, particularly the proportion of NBKP in the constituent fiber is more than 70 mass %. Preferably, the proportion of NBKP is more than 70 mass % and 100 mass % or less. NBKP has thicker and longer fiber over LBKP. Thus, when a large amount of NBKP is contained, the surface is roughed, and the smooth feeling is likely to decrease, but strength is likely to increase, and the firm feeling is easily enhanced. In addition, the paper layer tends to be loose because of proper entanglement of fibers.

The NBKP according to the present invention is preferably one derived from coniferous trees having flexible fiber with a low fiber roughness, such as cedar, cypress and spruce, which are produced in Scandinavia or North America. Specifically, softwood kraft pulp having a fiber roughness of 11.0 mg/100 m to 20.0 mg/100 m is preferable. NBKP whose fiber roughness is within the above-mentioned range is likely to have flexibility. On the other hand, it is desirable that the LBKP incorporated together with NBKP be derived from a uniform raw material such as eucalyptus which is obtained by tree plantation and at a lodging age of about 10 years. In particular, hardwood kraft pulp having a fiber roughness of 7.0 to 13.0 mg/100 m is preferable. The surface becomes smooth.

The tissue paper according to the present invention is moisturizer-applied tissue paper, which is also called a moisturized tissue, a lotion tissue, a chemical solution-applied-type tissue, or the like. Since a moisturizer is contained, roughness of the surface due to a high proportion of NBKP is unlikely to be felt.

The moisturizer according to the present invention contains, as a main component, a polyol having an action of taking moisture into the paper due to hygroscopicity to increase the moisture percentage. Therefore, the tissue paper according to this embodiment contains a polyol. The polyol is an aliphatic compound having two or more hydroxy groups (—OH), and has an effect of improving the moisture percentage due to hygroscopicity. Sugars having hygroscopicity are also included. Compounds suitable as polyols according to this embodiment are glycerin, diglycerin, triglycerin, propylene glycol, 1,3-butylene glycol, polyethylene glycol, sorbitol, glucose, xylitol, maltitol, maltitol, mannitol, trehalose, arabinose, galactose, xylose, xylobiose, xylooligosaccharide, sucrose and rhamnose, and may be mixtures thereof. Particularly suitable polyols are glycerin, diglycerin and mixtures thereof.

Examples of the components other than the main component in the moisturizer according to this embodiment include aloe extract, *Isodon japonicus* extract, *Hypericum erectum* extract, barley extract, orange extract, seaweed extract, chamomile extract, cucumber extract, comfrey extract, burdock extract, shiitake mushroom extract, rehmanniae radix extract, beefsteak plant extract, sage extract, duke extract, plant worm extract, doku-dami extract, clustered domecap extract, loquat extract, grape leaf extract, *Tilia cordata* extract, prune extract, sponge cucumber extract, moutan bark extract, *Rosa maikwai* extract, peach leaf extract, lily extract, apple extract, almond oil, olive oil, sesame oil, safflower oil, soybean oil, camellia oil, castor oil, jojoba oil, mink oil, palm oil, beeswax, hyaluronic acid, placenta extract, rhamnose, xylobiose, xylooligosaccharide, tuberose polysaccharide, trisaccharide, soluble collagen, glycyrrhizin, chondroitin sulfate, squalane, ceramide-like compounds, urea, vitamin C phosphate calcium salt, vitamin E, sodium pyrrolidone carboxylate, hinokitiol, liquid paraffin and vaseline. One or more of these compounds may be contained. Of these, aloe extract, *Isodon japonicus* extract, *Hypericum erectum* extract, comfrey extract, beefsteak plant extract, sage extract, ceramide-like compounds, doku-dami extract, clustered domecap extract, loquat extract, *Tilia cordata* extract, moutan bark extract, castor oil, jojoba oil, hyaluronic acid, placenta extract, soluble collagen, chondroitin sulfate, squalane and urea are more preferable.

The polyol content in the tissue paper according to this embodiment is 26.0 mass % or more and 30.0 mass % or less. The polyol content is determined from, for example, a value obtained by performing quantitative determination with a gas chromatography hydrogen flame ionization detector. Acetone extraction is performed with a Soxhlet extractor using humidity-conditioned tissue paper as a reference specimen, and the extracted solvent is dried, and fed to a gas chromatography hydrogen flame ionization detector. The ratio of the total mass of polyols such as glycerin contained in the tissue paper humidity-conditioned under the conditions of JIS P 8111 (1998) is the content in mass % of polyols. The polyol content in the present invention is extremely higher than a conventional polyol content. In the tissue paper according to the invention, the proportion of NBKP is as high as more than 70 mass %, the fiber assembly is loose, so that the polyol content can be increased, and therefore, roughness of the surface due to NBKP is less likely to be felt.

For the base paper to contain a polyol, a so-called aqueous moisturizing chemical solution containing the polyol as a main component may be applied by a gravure method, a flexographic method or a spray method. The application position in the production process is based on a known technique.

Since the tissue paper according to the present invention contains a polyol or the like as a moisturizer as described above, the moisture percentage is 13 mass % or more. This moisture percentage is extremely high among moisture percentages of moisturized tissue. Due to the high moisture percentage, it is easy to give a "moist feeling". The moisture percentage here is a value obtained by performing measurement in accordance with JIS P 8127 (1998) after a sample is humidity-conditioned under the conditions of JIS P 8111 (1998). Specifically, tissue paper humidity-conditioned under the standard conditions of JIS P 8111 is provided as a sample, the tissue paper is dried to a constant mass in an environment at 65° C. and a humidity of 20%, and the ratio of the moisture content in the tissue paper to the mass of the humidity-conditioned tissue paper is determined from the following equation.

(moisture percentage of tissue paper(%))=((mass of humidity-conditioned tissue paper(*g*))−(mass *g* of dried tissue paper(*g*))/(mass of humidity-conditioned tissue paper(*g*)))

It is preferable that the moisturizer in the tissue paper according to this embodiment is applied to the base paper as a chemical solution by external addition. The method of externally adding the chemical solution to the base paper can be carried out by a known technique such as spray coating, printing coating or roll transfer. The chemical solution may contain known auxiliary agents such as an emulsifier, a preservative and an antifoaming agent.

The tissue paper according to the present invention has a basis weight of 15 g/m$^2$ or more and 18 g/m$^2$ or less per ply. This basis weight is slightly higher than that of general-purpose tissue paper which is called a general-purpose product or a low-priced product. When the basis weight is within the above-mentioned range, it is possible to obtain excellent softness, smoothness and toughness also due to other factors of the configuration. The tissue paper according to this embodiment has a paper thickness of 220 to 330 μm. This paper thickness is very large for tissue paper, and it has been heretofore considered that hardness is likely to be felt when tissue paper has such a thickness, but in the present invention, it is possible to obtain excellent softness, smoothness and toughness due to the blending ratio of NBKP and the polyol content as well as specific surface properties as described later.

Since the tissue paper according to this embodiment has a slightly high basis weight and a very large paper thickness, so that the "moist feeling" is effectively enhanced due to improvement of the moisture percentage by a polyol or the like.

In the present invention, the basis weight means a value obtained by performing measurement in accordance with JIS P 8124 (1998), and the paper thickness means a value obtained by sufficiently conditioning a test piece under the conditions of JIS P 8111 (1998), and then performing measurement under the same conditions by use of a dial thickness gauge (thickness measuring instrument) "PEACOCK G type" (manufactured by OZAKI MFG. CO., LTD.). In the specific procedure for the measurement of the paper thickness, it is confirmed that dust, dirt or the like is not present between a plunger and a measuring table, the plunger is placed on the measuring table, the scale on the dial thickness gauge is moved to set the zero point, the plunger is then raised to place a sample on a sample table, the plunger is slowly moved down, and the gauge at this time is read. At this time, the plunger is merely placed. The terminal of the plunger is made of metal. A circular plane with a diameter of 10 mm perpendicularly hits the plane of paper, and the load during the measurement the paper thickness is about 70 gf. The average value obtained by performing the measurement 10 times is employed.

An arithmetic mean curvature at the peak point of the outer surface in an unpressurized state (Spc (1)) of the tissue paper according to the present invention is 4.0 to 4.8 (1/mm). The term "in an unpressurized state" means that measurement is performed as it is (the same applies to the developed area ratio at an interface (Sdr)). The arithmetic mean curvature at the peak point refers to the arithmetic mean value of the principal curvatures at the peak points in the defined region. The smaller the value, the more rounded the point of contact with another object, and the larger the value, the sharper the point of contact with another object. In a sample obtained from a pop-up-type bundle, the measurement surface is a surface corresponding to the mountain side of the fold (the same applies to the developed area ratio at an interface (Sdr)). When the arithmetic mean curvature at the peak point of the outer surface in an unpressurized state (Spc (1)) is 4.0 to 4.8 (1/mm), the surface is excellent in wiping property while being felt soft.

A developed area ratio at the interface on the outer surface (Sdr) of the tissue paper according to the present invention is 0.020 to 0.030 (–). The developed area ratio at the interface (Sdr) indicates how much the developed area (surface area) of the defined region increases with respect to the area of the defined region. When the developed area ratio at the interface (Sdr) is 0.020 to 0.030 (–), flexibility in the planar direction at the time of touching the skin with tissue paper is secured, so that softness is likely to be felt.

In the tissue paper according to the present invention, it is desirable that the amount of change between the arithmetic mean curvature at the peak point of the outer surface in an unpressurized state (Spc (1)) and the arithmetic mean curvature at the peak point of the outer surface under a pressure of 50 gf/cm$^2$ (Spc (2)) be Δ2.2 to Δ2.7 (1/mm). The pressure of 50 gf/cm$^2$ is roughly equivalent to a pressure at which the skin is pressed at the time of blowing the nose. This amount of change is the degree to which the roundness of a point contacting another object (human skin) is collapsed under pressure, and when the amount of change is within the range specified in the present invention, moderate collapse of the tip improves texture and the snot wiping property in blowing the nose.

The "arithmetic mean curvature at the peak point (Spc (1))", the "developed area ratio at the interface (Sdr)" and the "arithmetic mean curvature at the peak point under a pressure of 50 gf/cm$^2$ (Spc (2))" according to the present invention are values obtained by performing measurement by use of a "one-shot 3D shape measuring machine VR-3200 manufactured by KEYENCE CORPORATION (hereinafter referred to as a "3D macroscope" or its equivalent (contactless three-dimensional instrument). The "3D microscope" is capable of measuring the shape from a fringe projection image of an object projected on the monochromic C-MOS camera by structured illumination light emitted from a floodlighting section, and in particular, capable of measuring the height, length, angle, volume or the like of any portion by use of the fringe projection image. Software "VR-H2A" or equivalent software can be used for observing, measuring and analyzing images obtained by the "3D microscope". The measurement conditions are a visual field area of 24 mm×18 mm and a magnification of 12 times.

The specific measurement procedures for the arithmetic mean curvature of the peak points in an unpressurized state (Spc (1)) and the developed area ratio at the interface (Sdr) are as follows.

Tissue paper in the form of a ply, which is a test piece with a size of about 50 mm in the MD direction and 50 mm in the CD direction, is placed on a measurement table as it is in such a manner that the length direction coincides with the MD direction with the measuring machine placed on the front. The test piece used for measurement is a flat portion of a creaseless product.

The test piece is set on the measuring table in such a manner that a region having no embosses or creases is at the center of the visual field range. This ensures that the measurement region is free of embosses or creases. For this setting, the visual field range displayed on the monitor is referred to visually or via software.

Figure 2:
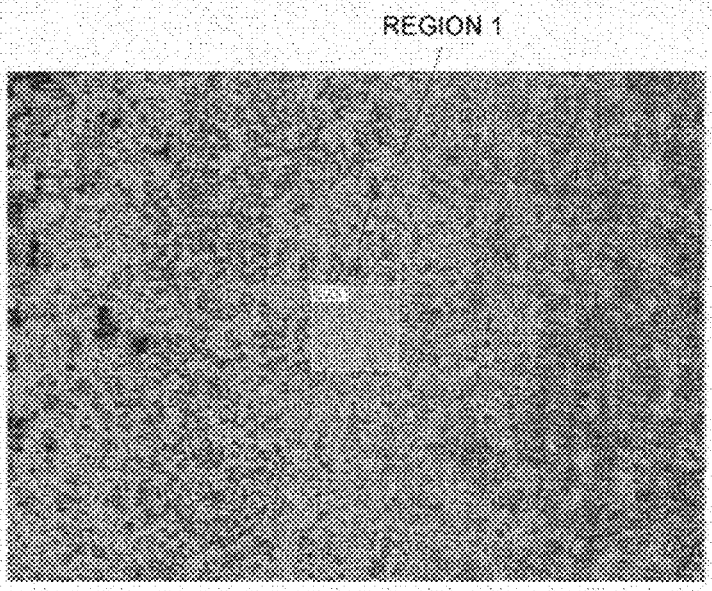
FIG. 2 is a diagram illustrating a method for measuring an arithmetic mean curvature at a peak point and a developed area ratio at an interface in the present invention.

Next, the profile of the test piece surface is captured by use of software ("VR-H2A"). Here, three images are obtained which are a main image (texture), a main image (height) and a 3D image. Next, the "surface roughness" is measured with the software. Here, it is desirable to display a "height" image (image represented by the contrasting density of color tones color-coded in the height direction) as shown in FIG. 2. In FIG. 2, the "height" image is represented by grayscale, but the actually obtained "height" image is an image represented by the contrasting density of color tones color-coded in the height direction.

Next, at least the maximum height (Sz), the arithmetic mean curvature at the peak point (Spc) and the developed area ratio at the interface (Sdr) are set as measurement parameters, followed by performing measurement. The measurement range has a size of 3.000 mm×3.000 mm. The software enables the measurement range to be set by selecting "specify value" in "add region".

The measurement spot is at approximately the center of the obtained image (e.g. region 1 in FIG. 2). The approximately center thoroughly includes a range of 10.0 mm×10.0 mm from the center of the image. The purpose of selecting this spot is to ensure that the test piece is set so as not to include portions having embosses or creases, less correction is needed and higher accuracy is obtained than on the edge, and intentional selection of a measurement spot after examination of a height image is prevented.

The values of the measured maximum height (Sz), arithmetic mean curvature at the peak point (Spc) and developed area ratio at the interface (Sdr) are checked, and if the maximum height (Sz) exceeds 0.3 mm, the value thereof is abandoned, and measurement is performed again with another test piece. For the measurement conditions, shape correction is performed with a Gaussian filter, a low-pass filter or a high-pass filter is not used, and correction of the edge is performed. Preprocessing of the image is not performed.

The flat surface roughness measurement is performed a total of five times with different test pieces, and the average of the five measurements is taken as the measured value of the arithmetic mean curvature at the peak point (Spc (1)) and the developed area ratio at the interface (Sdr) for the measurement sample. The arithmetic mean curvature (Spc (1)) and the developed area ratio at the interface (Sdr) may be measured at the same time, or the test piece to be measured may be changed.

Next, the procedure for measuring the arithmetic mean curvature at the peak point under a pressure of 50 gf/cm$^2$ (Spc (2)) will be described. For the procedure for measuring the arithmetic mean curvature at the peak point under a pressure of 50 gf/cm$^2$ (Spc (2)), the arithmetic mean curvature at the peak point is measured by the same procedure as that in an unpressurized state with a force of 50 gf/cm$^2$ evenly applied to the inside of the measurement region. The method for placing the sample under a pressure of 50 gf/cm$^2$ is not limited, and a method as described below is desirable.

First, a plate of 30 mm×30 mm×3 mm in thickness with a flat surface is placed on a measuring table. The plate may be one capable of forming a horizontal and flat portion over a range of 30 mm×30 mm on the measuring table. For example, an acrylic plate, an acrylic underlay, or the like can be used. A commercially available acrylic underlay is sufficient has sufficient surface smoothness.

The test piece is then placed on the acrylic plate. It is desirable that this test piece be a test piece subjected to measurement of the arithmetic mean curvature at the peak point in an unpressurized state (Spc (1)). Test pieces are collected at least from the same tissue paper. The size of the test piece and the direction with respect to the instrument are the same as in measurement of the arithmetic mean curvature at the peak point in an unpressurized state (Spc (1)).

A pressure of 50 gf/cm$^2$ is applied by gently placing a transparent acrylic plate (21 g) with a size of 100 mm×60 mm×3 mm in thickness on the test piece placed on the acrylic plate. A stainless frame of 100 mm×60 mm×4 mm in thickness (hollow 70 mm×40 mm) (133 g) is placed on the acrylic plate on the test piece. Further, a total of 450 g of weight is placed so as to apply pressure to the stainless steel frame evenly on the left and right sides and front and back sides. Here, the pressure applied to the central part (30 mm×30 mm) of the sample is 50 gf/cm$^2$. It is desirable to use an Acrysunday plate 3 mm in thickness (transparent) manufacture by Acrysunday Co., Ltd. or an equivalent product as the acrylic plate placed on the sample.

After completion of setting of the sample in this way, the same measurement as the measurement of the arithmetic mean curvature in an unpressurized state (Spc (1)) is performed, and the average of the measurements for five different test pieces is taken as the arithmetic mean curvature at the peak point of the outer surface under pressure (Spc (2)). The difference in measured value which results from a difference in refractive index between the acrylic plate and the air is ignored because the thickness of the acrylic plate is as thin as 3 mm and thus the effect on the measured value is small. It is desirable that the method for applying a pressure of 50 gf/cm$^2$ to the sample be the above-described method, and any method may be used as long as similarly to the above-mentioned method, measurement can be performed with the "3D microscope" after a pressure of 50 gf/cm$^2$ is applied to the measurement surface as described above.

On the other hand, the tissue paper according to the present invention is a moisturized tissue which is excellent in softness and moist feeling, and also excellent in strength such as a firm feeling and resistance to breakage and snot wiping property because the blending ratio of NBKP is high, the polyol content is extremely high, the arithmetic mean curvature at the peak point of the outer surface in an unpressurized state (Spc (1)) and the amount of change between the arithmetic mean curvature at the peak point of the outer surface in an unpressurized state (Spc (1)) and the arithmetic mean curvature at the peak point of the outer surface under a pressure of 50 gf/cm$^2$ (Spc (2)) are as described above.

Here, for ensuring that the polyol content is extremely high, the arithmetic mean curvature at the peak point of the outer surface in an unpressurized state (Spc (1)), the developed area ratio at the interface (Sdr) and the amount of change between the arithmetic mean curvature at the peak point of the outer surface in an unpressurized state (Spc (1)) and the arithmetic mean curvature at the peak point of the outer surface under a pressure of 50 gf/cm$^2$ (Spc (2)) are as described above, the crepe ratio during base paper-making may be set to 26 to 30% while a high blending ratio of NBKP and an extremely high polyol content are maintained as described above. This crepe ratio is a very high crepe ratio in view of the fact that the crepe ratio during base paper-making of a conventional moisturized tissue is about 22% or less.

For the tissue paper according to the present invention, known softeners, wet paper strengthening agents and dry paper strengthening agents can be used, and the paper strength can be adjusted as appropriate. In addition, the tissue paper according to this embodiment has a high polyol oil content and a high moisture percentage, and therefore is not suitable for pop-up-type tissue paper products housed in paper-made storage boxes also called carton boxes, but suitable for film-packaged tissues using a packaging film made of resin.

Examples

Table 1 below shows the physical property values and the results of sensory evaluation for moisturized tissue paper according to this embodiment (Examples 1 to 7), moisturization-type tissue paper as comparative examples against the moisturized tissue paper (Comparative Examples 1 to 3), and Conventional Examples 1 to 4 of moisturized tissues. In addition, FIG. 1 graphically shows the results of sensory evaluation in Examples 1 to 6, conventional examples and comparative examples. Example 7 is an example of tissue paper having four plies.

The softness and MMD in the table were measured as follows.

[Softness]

Measurement was performed on the basis of a handle-o-meter method conforming to the JIS L 1096E method. The size of the test piece was 100 mm×100 mm, and the clearance was 5 mm. In each of the longitudinal direction and the lateral direction, measurement was performed five times per ply. The average of a total of 10 measurements was defined as softness in cN/100 mm (displayed to two places of decimals).

[MMD]

The surface of a friction element is brought into contact under a contact pressure of 25 g with the surface of a measurement sample given a tension of 20 g/cm in a predetermined direction, and is simultaneously moved by 2 cm at a speed of 0.1 cm/s in a direction substantially identical to the direction in which the tension is given, and the coefficient of friction at this time is measured by use of a frictional feeling tester KES-SE (manufactured by KATO TECH CO., LTD.). The value obtained by dividing the coefficient of friction by the friction distance (movement distance=2 cm) is MMD. The friction element is formed by mutually adjacent 20 piano wires P each having a diameter of 0.5 mm, and has a contact surface formed so as to have a length of 10 mm and a width of 10 mm. The contact surface is provided with a unit bulge portion having a tip formed by 20 piano wires P (curvature radius is 0.25 mm).

[Sensory Evaluation]

Using Comparative Example 4, which is a 3-ply conventional commercially available moisturized tissue, as a reference sample, the sample related to each example was evaluated on a seven-point scale with respect to this reference sample. The evaluation items were "toughness (firm feeling)", "moist feeling (moisture-retaining property)", "wiped feeling", "softness" and "smoothness" after free touching of the tissue paper. The number of subjects was 20, and values of evaluation were the average for the subjects.

TABLE 1

| | | | Comparative Example 1 | Comparative Example 2 | Example 1 | Example 2 | Example 3 | Example 4 | Example 5 | Example 6 | Example 7 | Comparative Example 3 | Comparative Example 4 | Comparative Example 5 | Comparative Example 6 | Comparative Example 7 |
|---|---|---|---|---|---|---|---|---|---|---|---|---|---|---|---|---|
| Base paper-making | Pulp combination NBKP | % | 60 | 70 | 95 | 95 | 80 | 100 | 80 | 95 | 95 | 95 | — | — | — | — |
| | Pulp combination LBKP | % | 40 | 30 | 5 | 5 | 20 | 0 | 20 | 5 | 5 | 5 | — | — | — | — |
| | Crepe ratio | % | 14 | 14 | 28 | 30 | 28 | 30 | 28 | 30 | 28 | 36 | — | — | — | — |
| | Dry paper strengthening agent | kg/t | 5 | 5 | 5 | 5 | 5 | 5 | 5 | 5 | 5 | 5 | — | — | — | — |
| | Wet paper strengthening agent | kg/t | 11 | 11 | 12 | 12 | 12 | 12 | 12 | 12 | 12 | 15 | — | — | — | — |
| | Fatty acid-based softener | kg/t | 0.6 | 0.8 | 2.0 | 2.0 | 1.7 | 2.0 | 2.0 | 2.0 | 2.0 | 0.0 | — | — | — | — |
| | Soft moisturizer | kg/t | 0.0 | 0.0 | 1.0 | 1.0 | 0.5 | 1.0 | 1.0 | 1.0 | 1.0 | 0.5 | — | — | — | — |
| | Blade edge angle | ° | 83.0 | 83.0 | 83.0 | 83.0 | 83.0 | 83.0 | 83.0 | 83.0 | 83.0 | 88.0 | | | | |
| | Blade height | mm | 1.2 | 1.2 | 1.2 | 1.2 | 1.2 | 1.2 | 1.2 | 1.2 | 1.2 | 1.2 | | | | |
| | Bevel angle | ° | 17.5 | 17.5 | 17.5 | 17.5 | 17.5 | 17.5 | 17.5 | 17.5 | 17.5 | 17.5 | | | | |
| | Weight per area 1P | $g/m^2$ | 14.1 | 14.3 | 14.5 | 14.7 | 14.3 | 14.7 | 14.5 | 14.6 | 14.6 | 14.6 | — | — | — | — |
| | Number of plies | sheets | 3 | 3 | 3 | 3 | 3 | 3 | 3 | 3 | 4 | 3 | 3 | 3 | 3 | 3 |
| | Paper thickness 1P | μm | 213 | 220 | 281 | 274 | 264 | 278 | 261 | 270 | 270 | 275 | — | — | — | — |
| | Dry paper strength (longitudinal) 3P | cN/25 mm | 330 | 345 | 588 | 550 | 573 | 555 | 578 | 585 | 562 | 620 | — | — | — | — |
| | Dry paper strength (lateral) 3P | cN/25 mm | 137 | 141 | 189 | 199 | 227 | 212 | 215 | 191 | 185 | 311 | — | — | — | — |
| | Wet paper strength (lateral) 3P | cN/25 mm | 54 | 69 | 189 | 190 | 193 | 185 | 191 | 180 | 180 | 255 | — | — | — | — |
| Processing | Weight per area 1P | $g/m^2$ | 15.3 | 15.5 | 15.9 | 16.1 | 15.9 | 16.3 | 16.4 | 16.8 | 15.2 | 17.1 | 15.7 | 16.1 | 16.2 | 21.1 |
| | Paper thickness (product) | μm | 202 | 211 | 228 | 235 | 238 | 231 | 227 | 225 | 314 | 219 | 222 | 233 | 200 | 134 |
| | Dry paper strength (longitudinal) (product) | cN/25 mm | 312 | 321 | 426 | 395 | 365 | 375 | 355 | 346 | 384 | 321 | 440 | 213 | 579 | 660 |
| | Dry paper strength (lateral) (product) | cN/25 mm | 90 | 111 | 128 | 120 | 118 | 110 | 100 | 106 | 146 | 99 | 143 | 110 | 120 | 92 |
| | Wet paper strength (lateral) (product) | cN/25 mm | 62 | 78 | 56 | 55 | 67 | 50 | 53 | 45 | 58 | 40 | 58 | 38 | 62 | 46 |
| | Softness 1P | cN/100 mm | 0.66 | 0.68 | 0.73 | 0.60 | 0.75 | 0.65 | 0.70 | 0.68 | 0.61 | 0.61 | 0.73 | 0.79 | 0.92 | 1.32 |

TABLE 1-continued

| | | | Comparative Example 1 | Comparative Example 2 | Example 1 | Example 2 | Example 3 | Example 4 | Example 5 | Example 6 | Example 7 | Comparative Example 3 | Comparative Example 4 | Comparative Example 5 | Comparative Example 6 | Comparative Example 7 |
|---|---|---|---|---|---|---|---|---|---|---|---|---|---|---|---|---|
| | MMD 1P | 1/100 | 7.4 | 6.6 | 5.9 | 7.0 | 7.4 | 6.5 | 6.0 | 6.3 | 6.4 | 6.2 | 7.6 | 6.9 | 8.2 | 9.4 |
| | Moisture content | % | 11.5 | 12.1 | 13.9 | 14.5 | 14.6 | 14.8 | 15.1 | 15.2 | 14.7 | 15.6 | 9.4 | 8.9 | 13.5 | 14.7 |
| | Chemical solution content | % | 25.0 | 25.0 | 26.0 | 26.0 | 27.5 | 27.5 | 30.0 | 32.0 | 30.0 | 34.5 | 19.0 | 20.0 | 19.9 | 37.5 |
| Surface state of product formation state | Arithmetic mean curvature at peak point (Spc) | 1/mm | 2.664 | 2.888 | 4.031 | 4.440 | 4.681 | 4.555 | 4.781 | 4.421 | 4.524 | 5.214 | 2.963 | 3.907 | 1.862 | 1.615 |
| | Developed area ratio at ainterface (Sdr) | — | 0.013 | 0.016 | 0.022 | 0.021 | 0.023 | 0.024 | 0.026 | 0.021 | 0.025 | 0.033 | 0.013 | 0.017 | 0.005 | 0.008 |
| Surface state of product pressurization state ($50gf/cm^2$) | Arithmetic mean curvature at peak point (Spc) | 1/mm | 1.760 | 1.760 | 1.778 | 2.007 | 2.100 | 1.999 | 2.136 | 2.018 | 2.122 | 2.333 | 1.760 | 1.861 | 0.958 | 1.474 |
| | Developed area ratio at interface (Sdr) | — | 0.005 | 0.005 | 0.007 | 0.006 | 0.007 | 0.005 | 0.006 | 0.006 | 0.005 | 0.007 | 0.005 | 0.005 | 0.001 | 0.003 |
| Surface state of product change by pressurization | Arithmetic mean curvature at peak point (Spc) | 1/mm | Δ 0.904 | Δ 1.128 | Δ 2.253 | Δ 2.433 | Δ 2.581 | Δ 2.556 | Δ 2.645 | Δ 2.403 | Δ 2.402 | Δ 2.881 | Δ 1.203 | Δ 2.046 | Δ 0.904 | Δ 0.141 |
| | Developed area ratio at interface (Sdr) | — | Δ 0.008 | Δ 0.011 | Δ 0.015 | Δ 0.015 | Δ 0.016 | Δ 0.019 | Δ 0.020 | Δ 0.015 | Δ 0.020 | Δ 0.026 | Δ 0.008 | Δ 0.013 | Δ 0.004 | Δ 0.005 |
| Sensory test evaluation on seven-point scale | Toughness (firmness) | 1 to 7 | 4.0 | 4.0 | 4.6 | 4.8 | 4.9 | 5.1 | 5.4 | 5.6 | 6.3 | 4.8 | 4.0 | 3.5 | 4.0 | 3.7 |
| | Moist feeling (moisture-retaining property) | 1 to 7 | 4.0 | 4.0 | 4.4 | 4.7 | 4.8 | 4.9 | 5.0 | 5.1 | 5.1 | 5.8 | 4.0 | 3.9 | 4.5 | 5.3 |
| | Wiped feeling | 1 to 7 | 3.9 | 3.8 | 4.8 | 4.9 | 5.1 | 5.8 | 6.1 | 6.3 | 6.5 | 4.5 | 4.0 | 3.9 | 4.5 | 5.3 |
| | Softness | 1 to 7 | 5.4 | 5.2 | 5.0 | 5.0 | 5.1 | 5.4 | 5.7 | 5.8 | 5.5 | 3.8 | 4.0 | 4.0 | 4.5 | 4.6 |
| | Smoothness | 1 to 7 | 5.3 | 5.1 | 4.6 | 4.7 | 4.8 | 4.8 | 5.3 | 5.1 | 5.3 | 3.9 | 4.0 | 4.0 | 4.4 | 5.5 |

*Reference

As shown in the results of the sensory evaluation in the table and FIG. 1, Examples 1 to 7 were superior to the reference sample in all of "toughness (firm feeling)", "moist feeling (moisture-retaining property)", "wiped feeling", "softness" and "smoothness". On the other hand, comparative examples were inferior to the reference sample in any of the evaluation items.

Comparison of the physical property values of examples with those of comparative examples show that in examples of the present invention, the values of the "arithmetic mean curvature at the peak point of the outer surface under an unpressurized state (Spc (1))" which represents the roundness of a point contacting another object such as a human skin are within the range of 4.0 to 4.8 (1/mm), and these values are larger than those in Comparative Examples 1, 2 and 4 to 7. This indicates that the surface of the product coated with a chemical solution is rough. It is presumed that the fiber is softened due to the high content of the chemical solution in spite of such surface properties, and good results of evaluation are obtained on textures such as softness and smoothness. Further, in examples, the developed area ratio at the interface on the outer surface (Sdr) is 0.020 to 0.030 (–). It is presumed that since the developed area ratio was within the above-mentioned range, flexibility in the planar direction became appropriate, good results of evaluation were obtained on softness, wiped feeling and smoothness. In examples, the amount of change between the arithmetic mean curvature at the peak point of the outer surface in an unpressurized state (Spc (1)) and the arithmetic mean curvature at the peak point of the outer surface under a pressure of 50 gf/cm$^2$ (Spc (2)) is large. This means that the peak points are likely to collapse when the tissue paper is pressed against the skin. Therefore, it is presumed that the tissue paper thoroughly followed the skin during wiping, and was thus evaluated as being excellent in wiped feeling and firm feeling. Thus, the tissue paper of the present invention is a moisturized tissue which is excellent in softness and moist feeling, and also excellent in strength such as a firm feeling and resistance to breakage and snot wiping property.

The invention claimed is:

1. Moisturized multi-ply tissue paper sheet, comprising:

a plurality of tissue paper plies, where each tissue paper ply of the plurality of tissue paper plies includes fibers, where 98 mass % or more of said fibers are pulp fibers, where more than 70 mass % of said pulp fibers are softwood kraft pulp fibers; and 26.0 to 30.0 mass % polyol, based on the total weight of the tissue paper sheet, wherein the tissue paper sheet has a thickness of 220 to 330 μm, and each ply of the plurality of tissue paper plies has a basis weight of 15 to 18 g/m$^2$ per ply, wherein an arithmetic mean curvature at a peak point of an outer surface in an unpressurized state (Spc (1)) is 4.0 to 4.8 (1/mm) of the tissue paper sheet, and a developed area ratio at an interface on the outer surface (Sdr) of the tissue paper sheet is 0.020 to 0.030 (–).

2. The tissue paper sheet according to claim 1, wherein an amount of change between the arithmetic mean curvature at the peak point of the outer surface in an unpressurized state (Spc (1)) and an arithmetic mean curvature at the peak point of the outer surface under a pressure of 50 gf/cm$^2$ (Spc (2)) is Δ2.2 to 66 2.7 (1/mm).

* * * * *